US008963780B2

(12) United States Patent
Hsu et al.

(10) Patent No.: US 8,963,780 B2
(45) Date of Patent: Feb. 24, 2015

(54) ANTENNA MODULE

(75) Inventors: Chien-Ming Hsu, Taipei (TW); Chiuan-Jian Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 158 days.

(21) Appl. No.: 13/568,956

(22) Filed: Aug. 7, 2012

(65) Prior Publication Data

US 2013/0044031 A1 Feb. 21, 2013

Related U.S. Application Data

(60) Provisional application No. 61/524,044, filed on Aug. 16, 2011.

(51) Int. Cl.

| | |
|---|---|
| ***H01Q 1/38*** | (2006.01) |
| ***H01Q 1/24*** | (2006.01) |
| ***H01Q 5/00*** | (2006.01) |

(52) U.S. Cl.

CPC ..... *H01Q 1/243* (2013.01); *H01Q 5/0062* (2013.01)

USPC ..... 343/700 MS; 343/702; 343/848

(58) Field of Classification Search

USPC ..... 343/700 MS, 702, 846, 848

See application file for complete search history.

(56) References Cited

U.S. PATENT DOCUMENTS

| | | | | |
|---|---|---|---|---|
| 7,688,275 | B2 | 3/2010 | Montgomery et al. | |
| 7,696,931 | B2 | 4/2010 | Kim et al. | |
| 7,825,863 | B2 * | 11/2010 | Martiskainen et al. | 343/702 |
| 8,378,897 | B2 * | 2/2013 | Lai et al. | 343/700 MS |

FOREIGN PATENT DOCUMENTS

| | | | |
|---|---|---|---|
| CN | 101106211 | A | 1/2008 |
| CN | 101375464 | A | 2/2009 |
| CN | 201741804 | U | 2/2011 |
| CN | 102055065 | A | 5/2011 |

* cited by examiner

*Primary Examiner* — Hoang V Nguyen

(74) *Attorney, Agent, or Firm* — Muncy, Geissler, Olds & Lowe, P.C.

(57) ABSTRACT

An antenna module is disclosed. The antenna module comprises a first conductive unit, a second conductive unit and a third conductive unit. The first conductive unit has a feeding point. The second conductive unit is disconnected with the first conductive unit electrically. The third conductive unit is disposed adjacent to the first conductive unit and electrically connected with the second conductive unit.

8 Claims, 6 Drawing Sheets

ANTENNA MODULE

CROSS REFERENCE TO RELATED APPLICATIONS

The non-provisional patent application claims priority to U.S. provisional patent application with Ser. No. 61/524,044 filed on Aug. 16, 2011. This and all other extrinsic materials discussed herein are incorporated by reference in their entirety.

BACKGROUND OF THE INVENTION

1. Field of Invention

The disclosure relates to an antenna module.

2. Related Art

The antennas of conventional mobile phones or tablet computers are usually planar inverted F antennas (PIFA) or monopole antennas. Since the operation bands of conventional communication electronic devices are ranged in low frequency such as from 824 MHz to 960 MHz, the above-mentioned conventional antennas can satisfy the requirements of the narrow bandwidth.

However, due to the rapid development of mobile communication, the latest 4th generation mobile communication specification (4G) has expanded the operation bandwidth at the low frequency to 700 MHz, which is different from the conventional major mobile communication specification (GSM, 960 MHz) by 260 MHz.

In order to increase the additional bandwidth, it is very common to configure another antenna of different operation band for broadening the available bandwidth. However, this method needs to provide a new feeding point as well as another coaxial cable for the additional antenna, which sufficiently increases the dimension of the entire electronic device. In other words, it is very difficult to design the additional antenna in the limited space of the small and compact communication devices.

Other methods for broadening the available bandwidth are to configure the capacitance or inductance matching circuit before the feeding point of the antenna or to weld capacitor or inductor on the antenna. However, these methods can only increase the limited bandwidth. This is because the bandwidth is mainly determined by the radiation impedance of the antenna body. Although the matching circuit configured by the reflective coefficient of the capacitance or inductance slightly improves the bandwidth, this small improvement can not satisfy the requirement for the new generation of mobile communication specification.

SUMMARY OF THE INVENTION

An antenna module comprises a first conductive unit, a second conductive unit and a third conductive unit is disclosed. The first conductive unit has a feeding point. The second conductive unit is electrically disconnected with the first conductive unit. The third conductive unit is disposed adjacent to the first conductive unit and electrically connected with the second conductive unit.

In one embodiment, when a signal is fed in through the feeding point, the first conductive unit generates a first current and the second conductive unit generates a second current. Herein the current directions of the first current and the second current are opposite.

In one embodiment, the second current is an induced current.

In one embodiment, the first conductive unit, the second conductive unit and/or the third conductive unit is a metal sheet.

In one embodiment, the antenna module further comprises an insulation body, and the first conductive unit and the second conductive unit are disposed on the insulation body.

In one embodiment, the second conductive unit has a grounding terminal.

In one embodiment, the first conductive unit generates a first band by a resonance of the first current, and the second conductive unit generates a second band by a resonance of the second current.

In one embodiment, the first band and the second band are different.

As mentioned above, the present disclosure provides an antenna module that has a simple structure so as to provide the operation bandwidth with larger range within the limited space. Accordingly, this disclosed antenna module can satisfy the requirements of various minimized and compact electronic devices, and provide broader bandwidth and multiple operation bands.

These and other features, aspects and advantages of the present invention will become better understood with regard to the following description, appended claims, and accompanying drawings.

DETAILED DESCRIPTION OF THE INVENTION

Figure 1:
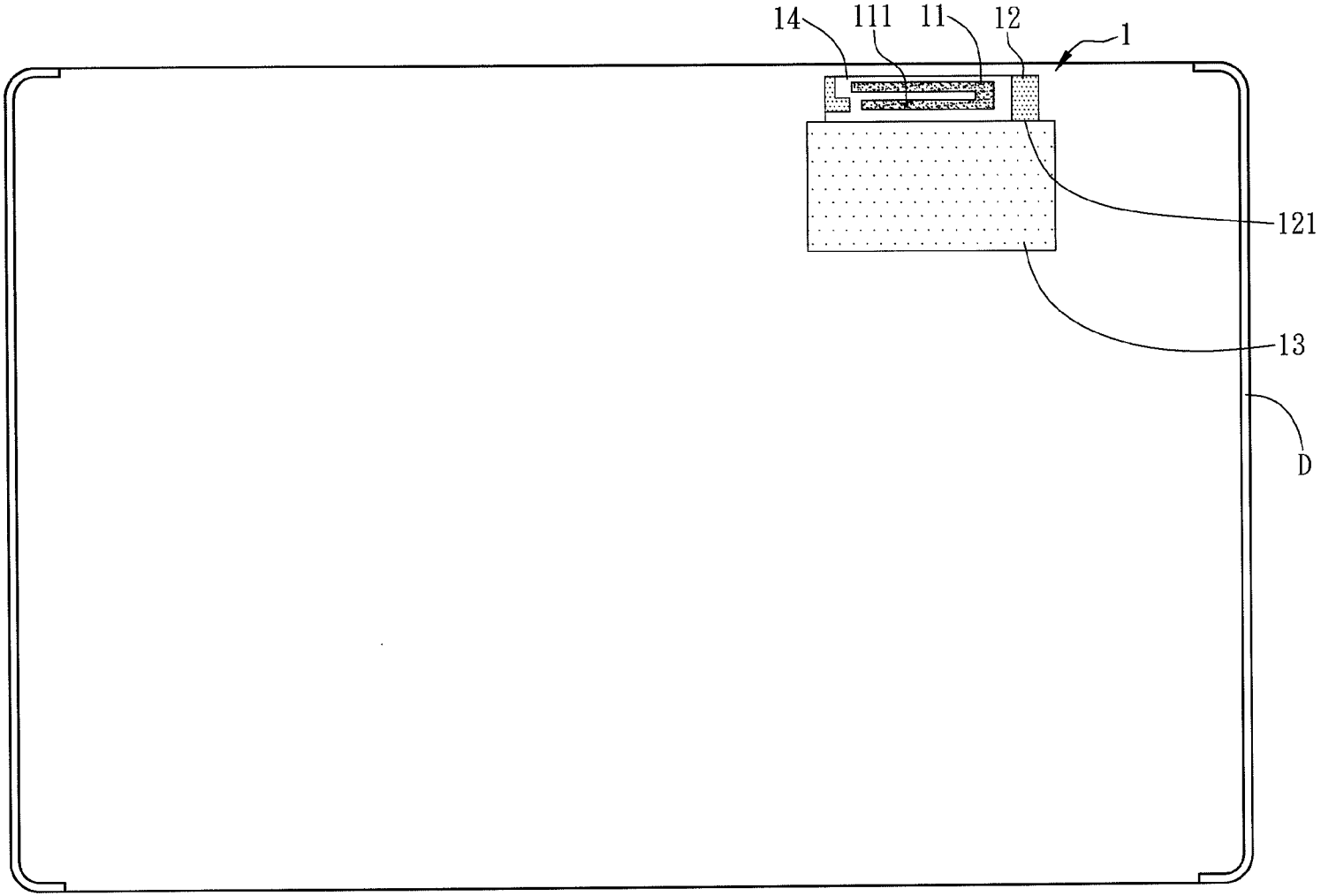
FIG. 1 is a schematic diagram showing an electronic device with an antenna module of this disclosure.
Figure 2:
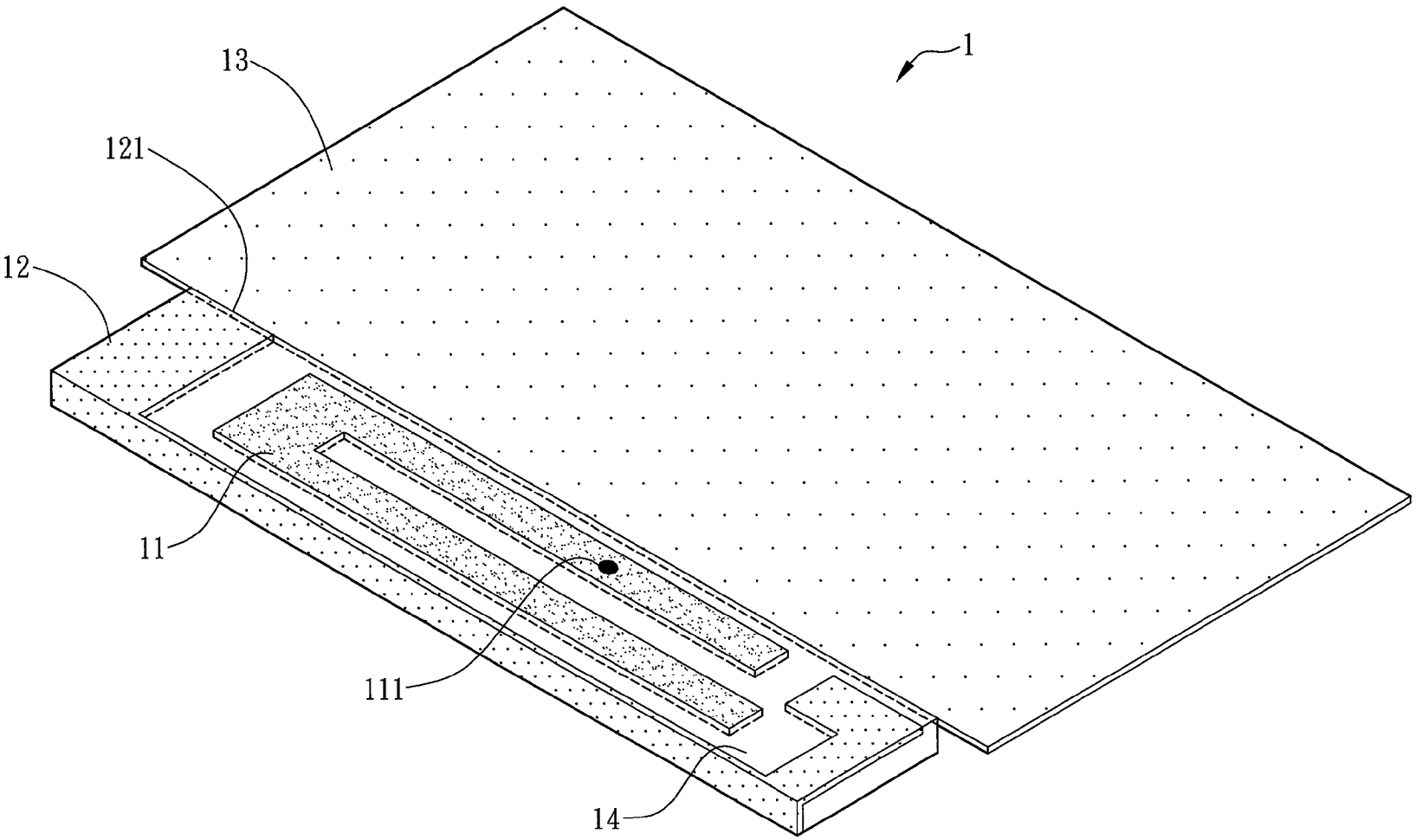
FIG. 2 is an enlarged view of the antenna module shown in FIG. 1.

FIG. 1 is a schematic diagram showing an electronic device with an antenna module 1 according to an embodiment of this disclosure, and FIG. 2 is an enlarged view of the antenna module 1 shown in FIG. 1. To be noted, the dimensions of those shown in the drawings may not be exactly the same as the real components, and some insignificant components are omitted so as to make the drawings simpler. The components showing in the drawings are for illustrations only and are not to limit the scope of the disclosure. The antenna module 1 can be configured in any electronic device. As shown in FIG. 1, the antenna module 1 is configured in a tablet computer D. To make the drawings more clear, the back casing and other internal components of the tablet computer D are not shown. Except the tablet computer, of course, the antenna module can also be applied to other portable electronic devices such as a smart phone, which is not limited herein.

Figure 3A:
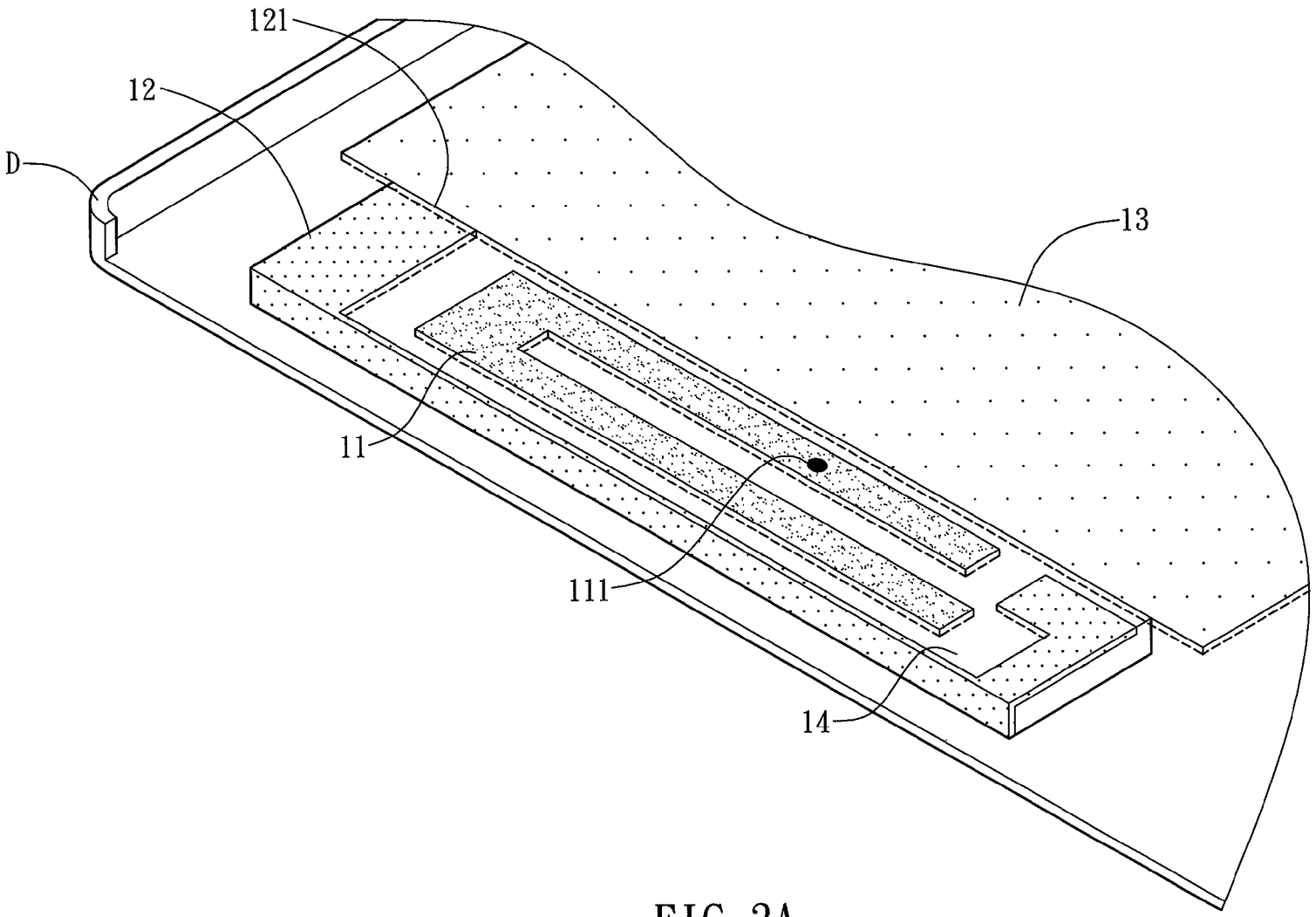
FIGS. 3A and 3B are schematic diagrams showing other aspects of the first and second conductive units of the antenna module.

The antenna module 1 comprises a first conductive unit 11, a second conductive unit 12, a third conductive unit 13 and an insulation body 14. In this embodiment, the insulation body 14 is a bulk, and the first conductive unit 11 and the second conductive unit 12 are disposed on the insulation body 14. In more specific, as shown in FIG. 3A, the first conductive unit 11 and the second conductive unit 12 are embedded on the insulation body 14.

Figure 3B:
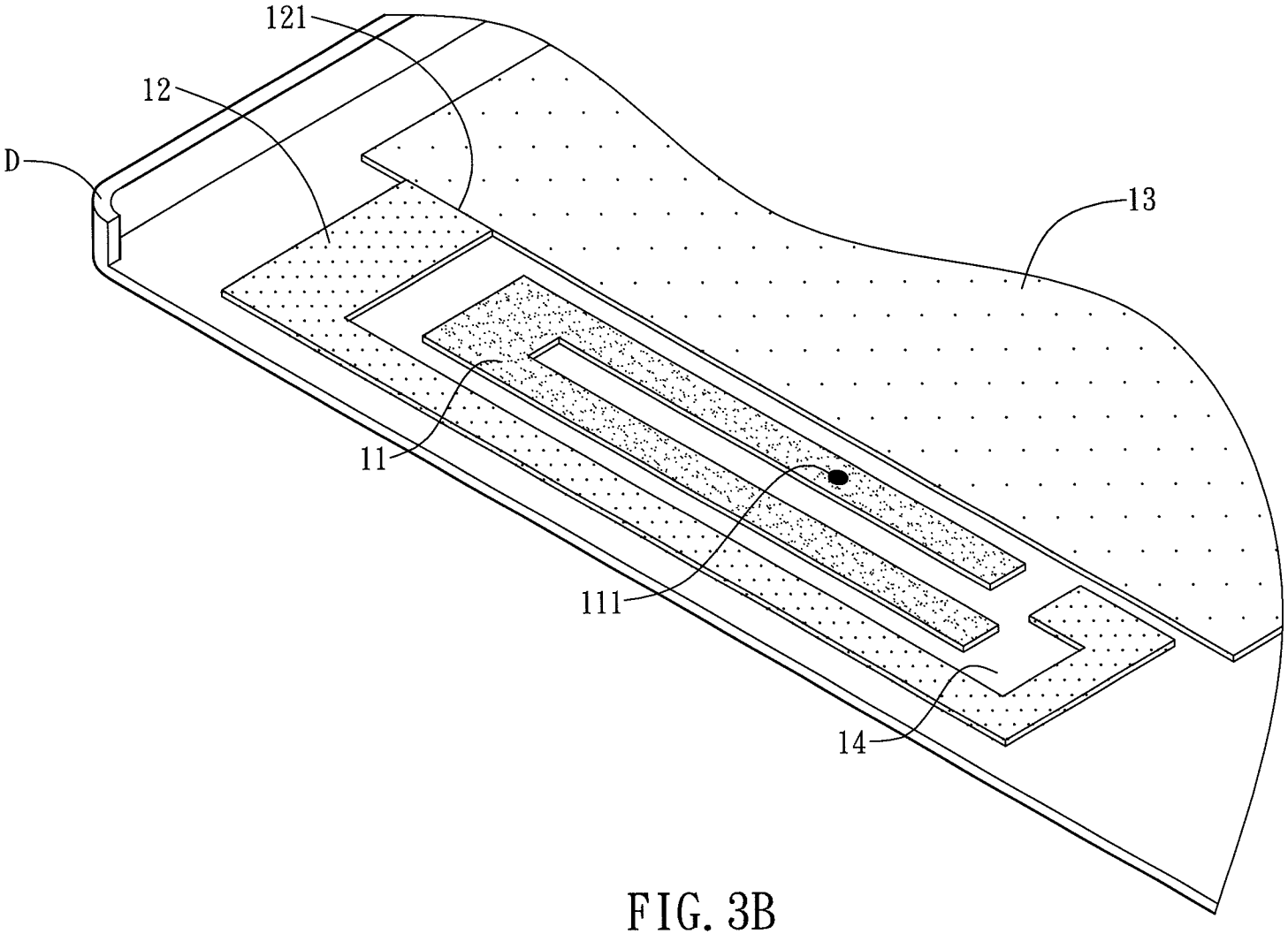

The material of the insulation body 14 includes resin or rubber. In an embodiment, the material of the insulation body 14 comprises glass fiber epoxy resin (e.g. FR4 (flame retardant type 4), BT resin (Bismaleimide-triazine resin), or polyimide (PI). In this embodiment, the material of the insulation body 14 is resin. Of course, the material of the insulation body 14 can be any other material with insulation property. As shown in FIG. 3B, the first conductive unit and the second conductive unit are not in contact, so that "air" can be used as the insulation body.

The shape and size of the insulation body 14 are not limited too. In this embodiment, the insulation body 14 has a flat plate shape. Of course, in other embodiments, the insulation body 14 can be rectangular block or other three-dimensional shapes to match with the configuration space of the applied electronic devices.

The first conductive unit 11 has a feeding point 111, and the second conductive unit 12 has a grounding terminal 121. As shown in FIG. 2, the insulation body 14 is made of the insulation material, and the first conductive unit 11 and the second conductive unit 12 are not in contact with each other. Thus, the first conductive unit 11 and the second conductive unit 12 are not electrically connected.

The third conductive unit 13 is an aluminum-magnesium alloy plate, which can be used as the metal frame of the tablet computer D for fixing components. This configuration can further reduce the manufacturing cost. The third conductive unit 13 and the second conductive unit 12 are directly connected at the grounding terminal 121, which means they are electrically connected. To be noted, the third conductive unit 13 is located adjacent to the first conductive unit 11, and the effect of this configuration will be described hereinafter.

In this embodiment, the first conductive unit 11, the second conductive unit 12 and the third conductive unit 13 are, for example but not limited to, metal plates. Besides, the shapes of the first conductive unit 11, the second conductive unit 12 and the third conductive unit 13 are, for example, a U shape, a flat plate with two bending portions, and a flat plate, respectively. To be noted, this disclosure is not limited to the above-mentioned materials and shapes. In other embodiments, the first conductive unit 11 may have a hoof shape or a flat long shape, or be varied depending on the applied electronic device, the product internal configuration, or the available bandwidth.

Figure 4:
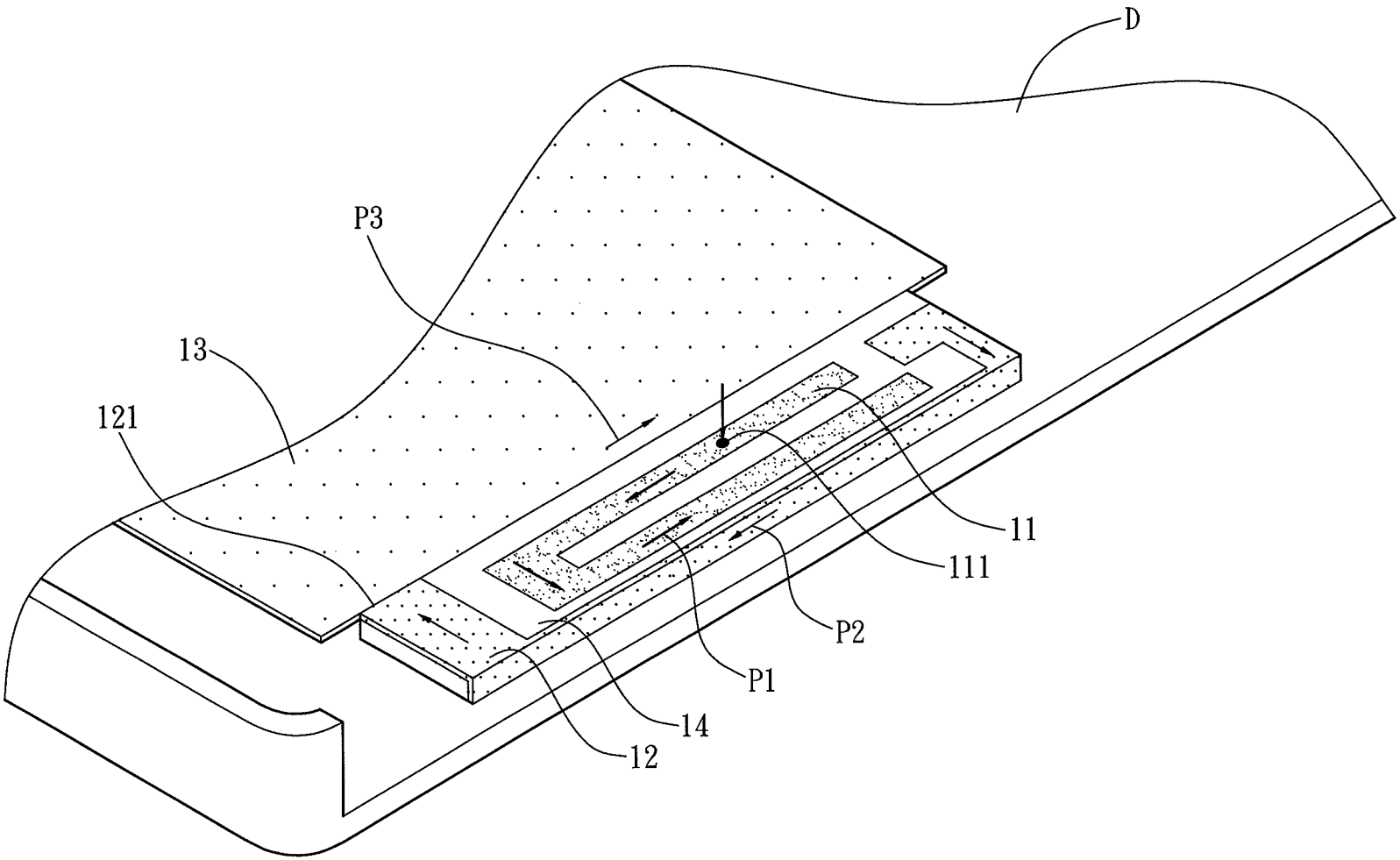
FIG. 4 is a schematic diagram showing the direction of the generated current of the antenna module when a signal is fed in through the feeding point.

FIG. 4 is a schematic diagram showing the direction of the generated current flowing on the first conductive unit 11, the second conductive unit 12 and the third conductive unit 13 of the antenna module 1 when a signal is fed in through the feeding point 111. Referring to FIG. 4, the antenna module 1 feeds in a signal to the feeding point 111 through a coaxial cable (not shown). When the signal is fed in, the first conductive unit 11 has a first current flowing along the path P1. Meanwhile, since the third conductive unit 13 is disposed adjacent to the first conductive unit 11, the first current can induce the third conductive unit 13 to generate the corresponding third current flowing along the path P3. In brief, the third current is an induced current of the first current, and the direction of the first and third currents are opposite to each other.

Moreover, since the third conductive unit 13 is electrically connected to the second conductive unit 12, the third current can drive the electrons of the second conductive unit 12 to move, thereby generating a second current flowing along the path P2. Herein, the directions of the second current and the third current are the same. In other words, when a signal is fed in, the second conductive unit is induced to generate a second current, and the directions of the first current and the second current are opposite to each other.

When the first current flows on the first conductive unit 11, the first conductive unit 11 is resonated so as to form a resonance mode. In addition when the second current is induced and flows on the second conductive unit 12, the second conductive unit 12 is also resonated so as to form another resonance mode.

To be noted, the second and third current are induced currents, so that the antenna module of this disclosure only needs a single feeding point and can achieve the resonances of two conductive units. This feature is different from the conventional art that configures two or more feeding points to generate desired feeding currents and to form the resonances of multiple conductive units. Accordingly, this disclosure can save the space for configuring multiple coaxial cables for the feeding points, and reduce the manufacturing cost.

In the above operations, since the antenna module 1 has at least two resonance modes, the desired operation frequencies can be easily designed by changing the related factors, such as the material and size of the conductive units, and the distance between the conductive units. In this embodiment, the first conductive unit 11 can generate a first band due to the resonance of the first current, and second conductive unit 12 can generate a second band due to the resonance of the second current. Herein, the first band is different from the second band. When the first conductive unit 11 and the second conductive unit 12 are resonated simultaneously, the range of the available bandwidth of the antenna module 1 can be properly broadened by combining two resonance modes. Thus, it is possible to provide more operation bands.

Figure 5:
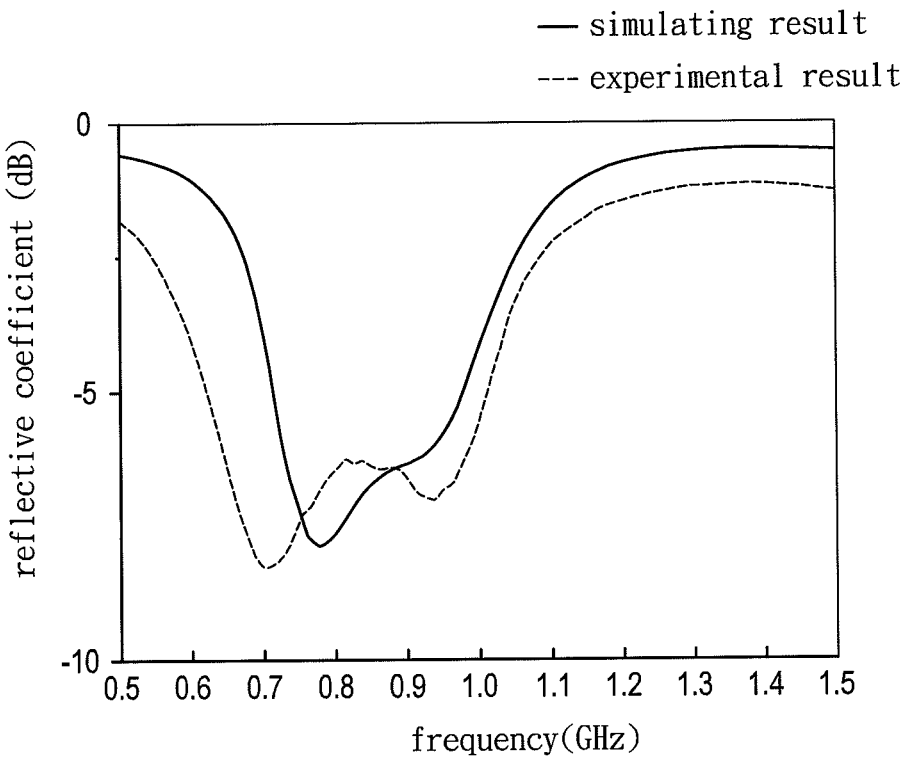
FIG. 5 is a graph showing the band simulating and experimental results of the antenna module of the disclosure.

With reference to the band simulating and experimental results of the antenna module 1 as shown in FIG. 5, the low frequency of the antenna module 1 can easily cover the range from about 700 MHz to 960 MHz. To be noted, the present disclosure is not limited to this, and the bands of the antenna module 1 can be changed by the above-mentioned methods for matching the requirements of different applications.

Based on the above design, the antenna module 1 employs a feeding point 111 to achieve the resonances of both the first conductive unit 11 and the second conductive unit 12. Besides, the first conductive unit 11 and the second conductive unit 12 have different bands, which mean that the antenna module 1 has an additional antenna, so that the antenna module 1 can cover the frequency of an additional band, thereby broadening the range of the operation bandwidth. Moreover, the size of the antenna module 1 is not increased, so it can satisfy the requirement of the compact mobile communication devices.

In summary, the antenna module of the disclosure is configured with a single feeding point. When a signal is fed in, the first conductive unit generates a first current, and then, the second and third conductive units are induced by the first current to generate a second current and a third current. Herein, the flowing directions of the second and third currents are opposite to the direction of the first current. Since the antenna module of this disclosure uses a single feeding point to form multiple resonance modes, the needed coaxial cables and antennas as well as the space for them can be sufficiently reduced. Besides, since it is not necessary to configure additional antenna module, the complexity of the module is also decreased, and the purposes of minimization and compact can be achieved. In addition, the conductive units of this disclosure can be integrated with the insulation body so as to further decrease the manufacturing cost.

In addition, the currents flowing on the first and second conductive units allow them to form the independent resonance modes. Accordingly, the antenna module of this disclosure can use the resonance modes to cover broader bandwidth, thereby broadening the available range of the mobile communication specification.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An antenna module, comprising:

a first conductive unit having a feeding point, wherein the first conductive unit has a first segment, a second segment and a third segment connected with the first segment and the second segment, and a slot having an opening is formed between the first segment and the second segment;

a second conductive unit not electrically connected with the first conductive unit, wherein the second conductive unit has a fourth segment; and a third conductive unit disposed adjacent to the first conductive unit and electrically connected with the second conductive unit through the fourth segment, wherein the opening faces away from the fourth segment.

2. The antenna module of claim 1, wherein when a signal is fed in through the feeding point, the first conductive unit generates a first current and the second conductive unit generates a second current, and wherein the current directions of the first current and the second current are opposite.

3. The antenna module of claim 2, wherein the second current is an induced current.

4. The antenna module of claim 1, wherein the first conductive unit, the second conductive unit and/or the third conductive unit is a metal sheet.

5. The antenna module of claim 1, further comprising:

an insulation body, wherein the first conductive unit and the second conductive unit are disposed on the insulation body.

6. The antenna module of claim 1, wherein the second conductive unit has a grounding terminal.

7. The antenna module of claim 1, wherein the first conductive unit generates a first band by a resonance of the first current, and the second conductive unit generates a second band by a resonance of the second current.

8. The antenna module of claim 7, wherein the first band and the second band are different.

* * * * *